US009045894B2

(12) United States Patent
Hartmann

(10) Patent No.: US 9,045,894 B2
(45) Date of Patent: Jun. 2, 2015

(54) CENTER-SUPPORTED WALL PANEL

(75) Inventor: Frederick Hartmann, Chicago, IL (US)

(73) Assignee: Frederick Hartmann, Chicago, IL (US)

( * ) Notice: Subject to any disclaimer, the term of this patent is extended or adjusted under 35 U.S.C. 154(b) by 238 days.

(21) Appl. No.: 13/470,043

(22) Filed: May 11, 2012

(65) Prior Publication Data

US 2013/0298492 A1 Nov. 14, 2013

(51) Int. Cl.

| | |
|---|---|
| ***E04B 1/19*** | (2006.01) |
| ***E04B 1/08*** | (2006.01) |
| ***E04B 2/58*** | (2006.01) |
| ***E04C 2/38*** | (2006.01) |
| *E04B 1/24* | (2006.01) |

(52) U.S. Cl.

CPC ... *E04B 1/08* (2013.01); *E04B 1/24* (2013.01); *E04B 2/58* (2013.01); *E04C 2/384* (2013.01)

(58) Field of Classification Search

CPC ..... E04B 1/24; E04B 1/08; E04B 2/58; E04B 2/7457; E04B 2/7854; E04C 2/38; E04C 2/384; E04C 2003/0473

USPC ..... 52/106, 638, 653.1, 653.2, 481.1, 693

See application file for complete search history.

(56) References Cited

U.S. PATENT DOCUMENTS

| | | | | | |
|---|---|---|---|---|---|
| 1,675,226 | A * | 6/1928 | Munroe et al. | 52/363 |
| 3,160,245 | A * | 12/1964 | Pavlecka | 52/275 |
| 3,333,390 | A * | 8/1967 | Banning | 52/846 |
| 3,925,948 | A * | 12/1975 | Sauer et al. | 52/481.2 |
| 4,235,054 | A * | 11/1980 | Cable et al. | 52/210 |
| 4,563,851 | A * | 1/1986 | Long | 52/656.1 |
| 5,632,127 | A * | 5/1997 | Agar et al. | 52/481.2 |
| 7,882,665 | B2 * | 2/2011 | Kawai et al. | 52/236.6 |
| 8,544,226 | B2 * | 10/2013 | Rubel | 52/236.6 |
| 2010/0095612 | A1 * | 4/2010 | Antonic | 52/210 |

* cited by examiner

*Primary Examiner* — Brian Glessner
*Assistant Examiner* — Adam Barlow
(74) *Attorney, Agent, or Firm* — Leydig, Voit & Mayer, Ltd.

(57) ABSTRACT

A wall panel is configured as a load-bearing structure for supporting vertical loading in a building. The wall panel forms a frame with first and second faces configured to receive sheathing and has thickness defined between the first and second faces. The wall panel includes a plurality of vertical load-bearing columns centrally disposed between the first and second faces of the wall panel frame. A load distribution member is disposed at the top of the wall panel and is coupled to the load-bearing columns, which are supported at the bottom of the wall panel by a lower member. A plurality of sheathing supports are disposed on opposite sides of the load bearing columns, and each includes an attachment surface disposed at a distance from the load-bearing column. The attachment surfaces define the respective faces of the wall panel frame and are configured to hold the sheathing.

17 Claims, 7 Drawing Sheets

CENTER-SUPPORTED WALL PANEL

FIELD OF THE INVENTION

The invention relates to modular wall panels for use in construction of high rise structures, including but not limited to floor support wall panels.

BACKGROUND OF THE INVENTION

When constructing high-rise buildings that include more than one floor, typical construction methods include creating a temporary support structure on a newly formed floor surface. This support structure is used to support molds that will form the next floor slab. Thus, the construction of multi-floor buildings requires the sequential pouring of floors, which also involves the erection and removal of support structures and/or scaffolding on successive floors.

Typical support structures include scaffolding constructed by tubing having a round cross section. Such scaffolding is erected on the floor slab of a newly poured floor to support molds that will be used to pour the floor above. The scaffolding may be dismantled when pouring of the above floor is complete, and moved for re-erection when successively pouring other floors.

The successive re-use of scaffolding in erecting, dismantling, and re-erecting the structure for each floor of a multi-story building can be quite labor intensive and time consuming. Moreover, the wall structures of the building must be constructed for the newly formed floors after the construction or pouring of the "floor" and "ceiling" slabs are complete.

BRIEF SUMMARY OF THE INVENTION

The present disclosure sets forth an advantageous wall panel and method of making the wall panel. In an embodiment, the wall panel is configured as a load-bearing structure for supporting vertical loading in a building. The wall panel forms a frame with first and second faces configured to receive sheathing and has thickness defined between the first and second faces. The wall panel includes a plurality of vertical load-bearing columns centrally disposed between the first and second faces of the wall panel frame. A load distribution member is disposed at the top of the wall panel and is coupled to the load-bearing columns, which are supported at the bottom of the wall panel by a lower member. A plurality of sheathing supports are disposed on opposite sides of the load bearing columns, each of the sheathing supports including an attachment surface disposed at a distance from the load-bearing columns, the attachment surfaces defining the respective faces of the wall panel frame and being configured to hold the sheathing on the wall panel frame.

BRIEF DESCRIPTION OF THE SEVERAL VIEWS OF THE DRAWINGS

Embodiments of the present invention are described in more detail below with reference to the drawings, in which.

DETAILED DESCRIPTION OF THE INVENTION

Figure 1:
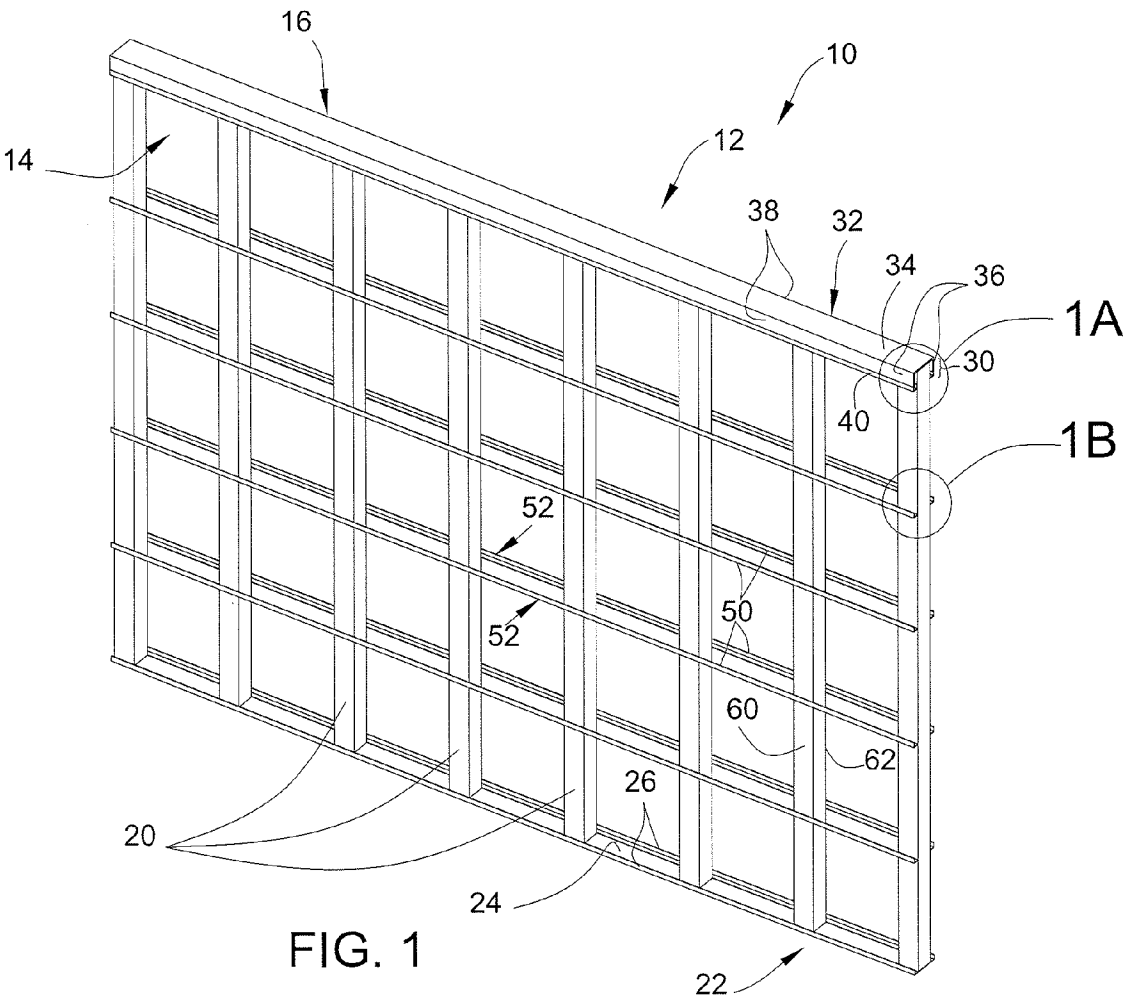
FIG. 1 shows a perspective view of a wall panel including a centrally disposed load-bearing columns.

FIG. 1 shows a wall panel that provides a load-bearing structure for supporting vertical loading in a building. Various different uses and advantages of wall panels, particularly with respect to their relationship with surrounding structural elements are described in U.S. patent application Ser. Nos. 12/868,474, now U.S. Pat. No. 8,448,387, and 13/163,540, now abandoned, which are hereby incorporated by reference herein in their entirety.

The wall panel 10 of FIG. 1 is configured as a load-bearing frame 12 and includes first and second broad faces 14, 16 that are configured to receive sheathing, which may be interior sheathing, such as dry-wall or gypsum board, or exterior sheathing. Of course, the wall panel may be configured such that the first face 14 of the wall panel is covered with exterior sheathing while the second face 16 is covered with interior sheathing. For internal wall sections, both faces can be covered with interior sheathing. The load bearing frame 12 of wall panel 10 includes a load distribution member 18 disposed at a top of the wall panel, a plurality of vertical load-bearing columns 20 spanning the height of the wall panel, and a lower member 22 supporting the columns 20.

As shown in FIG. 1, the load bearing columns 20 are disposed along the length of the wall panel in spaced apart relation. Distinct from other wall panel constructions, each load-bearing column 20 is centrally disposed with respect to the width of the wall between the first 14 and second 16 broad faces that are configured to receive sheathing. Thus, the load-bearing columns 20, which are spaced individually along the length of the wall panel 10, can be larger than the structural tubes used in many wall panels that are positioned together in pairs. As a result, the load capacity of each column 20 can be considerably higher than the individual structural tubes used in pairs in other wall panel constructions.

The size, shape, material and spacing of the load-bearing columns may be selected based on the load-bearing and other construction requirements of the wall. In the illustrated embodiments, the load bearing columns 20 are formed by square steel tubes of 4"×4" cross-section, and are spaced along the length of the wall panel every 24". However, the bearing columns could be formed by other materials, such as different structural metals or composites, or could take other forms such as beams or channels. Moreover, the cross-section of the columns could be smaller or larger depending on the load-bearing requirement of the wall and/or the wall panel thickness. Preferably, however, the load-bearing columns 20 will have a smaller cross-section than the thickness of the wall panel such that a space is left between each of the opposing sides of the load-bearing columns 20 and the respective neighboring face of the wall panel frame. The function of this space will be described in more detail below.

As set forth above, the load-bearing columns 20 are supported on a lower member 22 that defines the lower end of the wall panel frame. In one embodiment, the lower member 22 may also extend outward from the load-bearing columns 20, on either side, toward the first and second faces 14, 16 of the wall panel frame. For example, the lower member 22 may be formed by a steel track, which is in the form of a channel with a web 24 and two upwardly extending flanges 26, as shown in the drawings. In the illustrated embodiment, the lower member 22 is formed by 6" track with the 4"×4" steel tubes of the columns being centrally disposed between the flanges 26 of the track's channel, leaving a 1-inch space on each side of the steel tubes. Preferably, the load-distribution columns are attached to the lower member 22. This can be achieved by welding the steel tube columns to the web 24 of the steel track lower member 22 around the periphery of the column, with one or more weld segments or tacks. Alternatively, the steel tube columns 20 could be attached to the steel track lower member 22 by other means such as L-brackets and fasteners. In the illustrated arrangement, the side flanges 26 of the lower track are spaced from the first and second sides of the columns and are configured to receive sheathing mounted thereon. Accordingly, the track flanges 26 contribute to defining the thickness of the wall panel frame 12 and the location of the first and second wall panel faces 14, 16 that receive sheathing.

The load-bearing columns 20 extend up from the lower member 22 to the load distribution member 18 at the top of the wall panel 10. In the embodiment shown in FIG. 1, the load distribution member 18 is in the shape of a channel member 30 with a downward facing opening that receives the columns 20 therein, as shown in greater detail in FIG. 1A. The illustrated channel member 30 is formed by a structural channel 32 defined by a web 34 that extends across the top of the wall panel 10 and two flanges 36 that extend downward from the web 34 on opposite sides of the load-bearing columns 20. With the channel member 30 in place, the web 34 of the structural channel 32 is supported on the top end of the plurality of columns 20 of the wall panel. Thus, the top of the wall panel 10 provides a flat surface formed by the web 34 of the structural channel 32. Advantageously, this flat surface provides an appropriate support platform for loads disposed on top of the wall panel, such as structural components of the next higher floor in the structure or building being constructed. The load distribution member 18 directs the load from above the wall panel 10 down and through each of the load-bearing columns 20, so that the wall panel 10 is able to sufficiently support large loads disposed thereon, such as several additional floors of a building.

The width of the channel member 30, as defined by the width of the structural channel 32, is preferably sized so that the outward facing sides 38 of the flanges 36 align with the flanges 26 of the steel track lower member 22. As a result, the channel member 30 also contributes to defining the first and second faces 14, 16 of the wall panel frame 12 and the position of any sheathing that is attached to the wall panel 10.

Figure 1B:
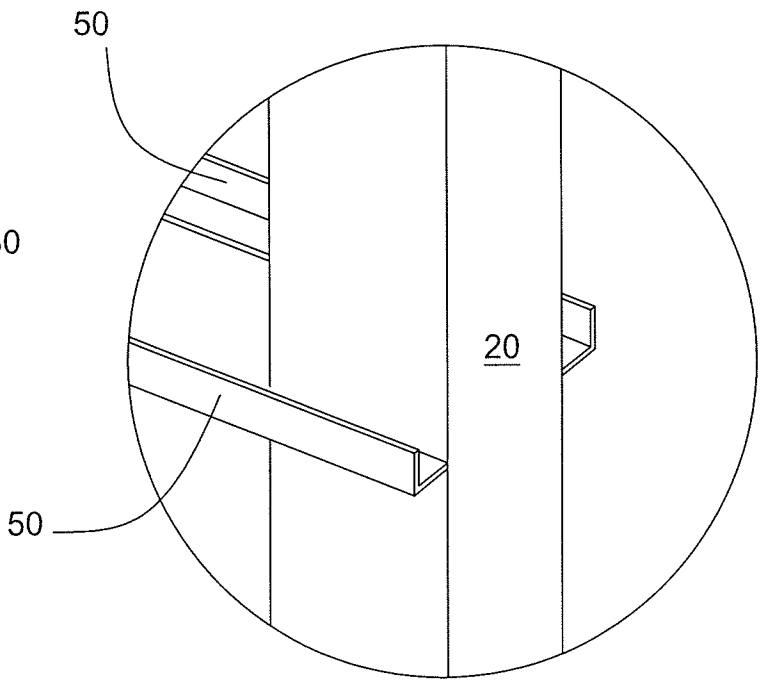
FIG. 1*b* shows a detailed view of a sheathing support of the wall panel of FIG. 1.
Figure 1A:
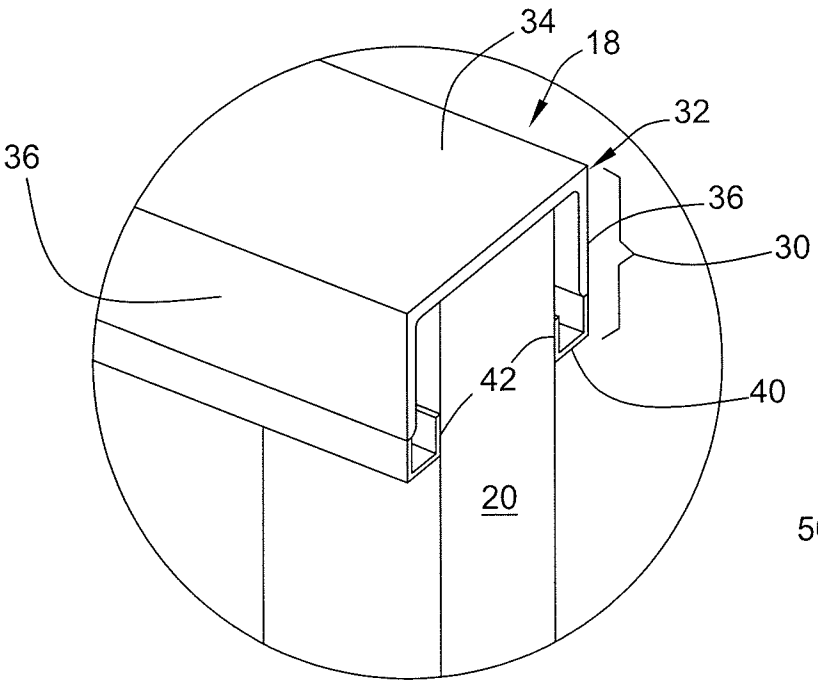
FIG. 1*a* shows a detailed view of a top portion of the wall panel of FIG. 1.

At a lower end of each of the flanges 36 of the structural channel 32 is a guide element 40 that extends inward from the respective first 14 or second 16 face of the wall panel frame 12 toward the columns, as can be seen in detail in FIG. 1A. Each of the guide elements 40 can include an guide surface 42 disposed on an inner side of the channel member 30 abutting, or nearly abutting, an adjacent face of a neighboring load-bearing column 20. This configuration, with two guide elements 40 disposed on opposite sides of the channel member 30, can be particularly advantageous when assembling the wall panel 10. Specifically, the channel member 30 can be prefabricated before attachment to the columns 20 by fixing the guide elements 40 on opposite sides of the structural channel 32 at the lower ends of the flanges 36, as explained above. As a result, the guide surfaces 42 of the guide elements 40 are spaced apart from one another on opposing sides of the guide channel 30 at or near the width of the columns. Thus, the columns can be easily positioned and held in place within the guide channel 30 of the load distribution member 18 until the columns 20 are fixed in place and attached to the load channel member 30 of the load distribution member 18. Similar to the connection between the columns 20 and the steel track of the lower member 22, the channel member 30 can also be fixed on the top end of the columns 20 by welding. Further, the connection between the columns 20 and the load distribution member 18 could alternatively be made with brackets and fasteners.

The size, shape and material of the load distribution member 18 and its components may be selected based on load-bearing and other construction requirements of the wall panel 10. In the specific embodiment illustrated in FIGS. 1 and 1A, the channel member 30 of the load distribution member 18 is formed by a unitary structural channel 32 and two smaller channels that form the guide elements 40. Alternatively, the structural channel 32 can be formed by individual components that are fastened together, such as a first plate to form the web 34 and two smaller plates to form the flanges 36 or a pair of angled members. In other embodiments, the guide elements 40 could be composed of different members, such as square tubing, solid spacers or plates. The illustrated channels that form the guide elements 40 advantageously provide a wide guide surface 42 towards the inside and a similar surface on the outside, which may be used for attaching members to the wall panel, such as sheathing. The shown load distribution member 18 is formed by a 6" wide MC channel with flanges 36 that may be between 2½ and 3½ inches long. As a result, the structural channel 32 extends by about 1-inch in an outward direction on both sides of the load-bearing columns 20. To accommodate the extension of the structural channel 32 on each side of the columns 20, the guide elements may be formed by C-channels measuring about 1×1 inches. The channels forming guide elements 40 are shown as opening on an upper side. It is also possible that the channels open on the inside or lower side.

Each broad side of the wall panel frame 12 includes a plurality of sheathing supports 50 that are coupled to the load-bearing columns 20. Each sheathing support 50 includes an attachment surface 52 for receiving a sheathing to finish the construction of a wall. The plane that is defined by the plurality of attachment surfaces 52 of the sheathing supports 50 on one side of the columns 20, thus, defines the corresponding face 14 or 16 of that side of the wall panel 10. As set forth above, the sheathing or hanger clips attached to sheathing materials such as stone are received on the sheathing supports 50, and thus on the wall panel 10. Alternatively, interior sheathing material such as drywall or wood can be attached by driving fasteners directly into the sheathing supports 50. In the embodiment shown in FIG. 1, the sheathing supports 50 run horizontally and are attached directly to a neighboring side of each of the columns 20 along the length of the wall panel 10. Thus, on a first side of the wall panel, a plurality of sheathing supports 50 are coupled to a first side 60 of each column 20. The sheathing supports 50 are further arranged to provide the attachment surface 52 along the length of the wall panel at a distance from the first side 60 of the first side 60 of the columns 20, and thereby form the first face 14 of the wall panel. Similarly, additional sheathing supports 50 are coupled to a second side 62 of each of the columns 20 and also arranged to provide their respective attachment surfaces at a distance from the second sides 62 of the columns 20 and thereby form the second face 16 of the wall panel. Preferably, the attachment surfaces 52 of the sheathing supports 50 on each side of the wall panel are aligned with the outer surface of the flange 26 of the steel track lower member 22 and with the outer surface channel member 30 on the respective side of the wall panel 10. Further, it is contemplated that the orientation and number of sheathing supports 50 can be tailored to be compatible with any particular type of sheathing.

In the embodiment of FIG. 1, shown in further detail in FIG. 1B, the sheathing supports 50 are formed by angle members, with the end of one leg of the angle member being fixed to the respective side 60, 62 of the column 20. The second leg of the angle member is thus set apart from the column 20 and forms the attachment surface 52. The sheathing supports 50 can also be formed of other structural elements such as hollow sections, beams, or channels, as shown and described in more detail below. The specific material used for the sheathing supports 50 shown in FIG. 1 is a 1×1 inch steel angle. This size sets the attachment surface 52 of the sheathing supports 50 at 1-inch from the columns 20 on each side of the wall panel 10 in alignment with the flanges 26 of the track of the lower member 22 and the flanges 36 of the structural channel 32 of the load distribution member 18.

Figure 2:
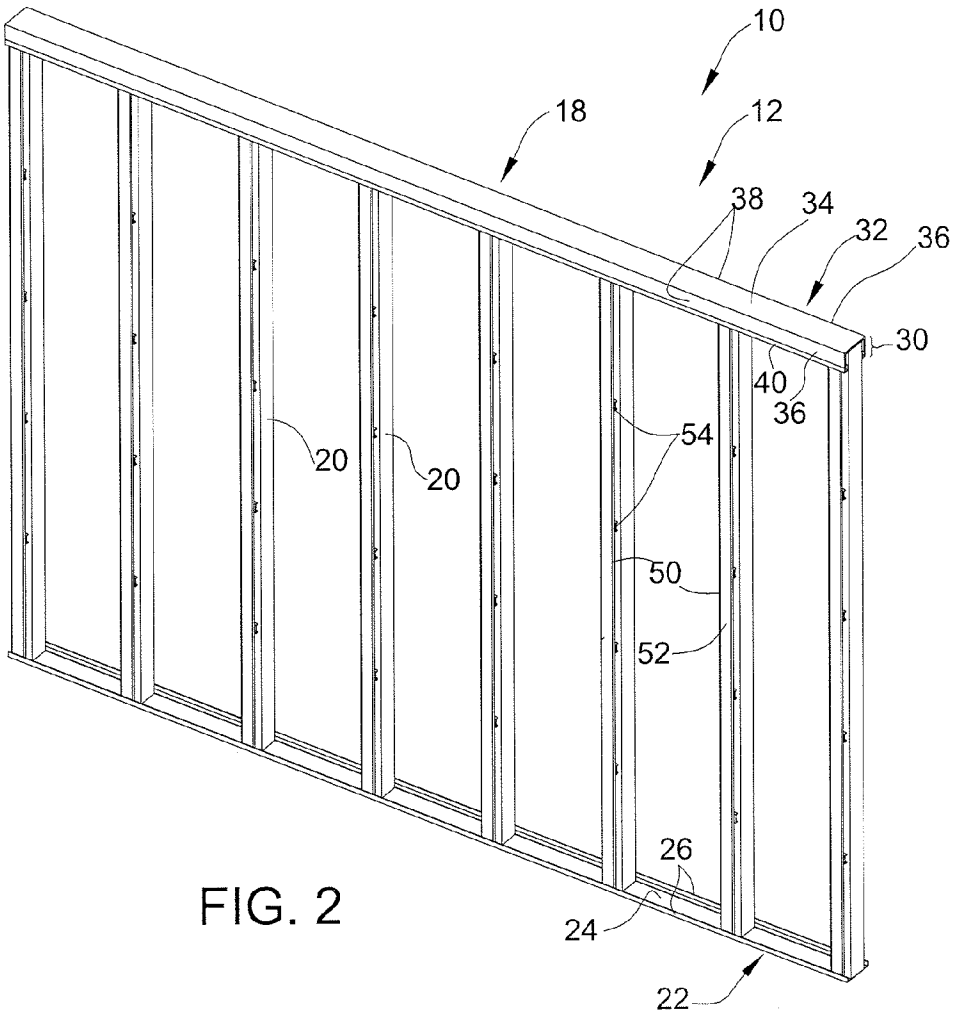
FIG. 2 shows a perspective view of another embodiment of a wall panel including centrally disposed load-bearing columns.

FIG. 2 shows another embodiment of a wall panel 10 including centrally disposed load-bearing columns 20. Similar to the embodiment of FIG. 1, the columns 20 are supported on a lower member 22 formed by a steel track channel, abutting a web 24 of the channel and centrally disposed between the flanges 26. Likewise, the load distribution member is also formed by a channel member 30 including a structural channel 32 opening downward and two guide elements 40 disposed at ends of the flanges 36 of the structural channel 32. It should be appreciated that each of the features of the wall panel shown in FIG. 2 may be embodied by the descriptions set forth above with respect to FIG. 1, except where otherwise indicated.

The wall panel 10, of FIG. 2 differs from that shown in FIG. 1, in that the sheathing supports 50 extend vertically from a lower end of the wall panel toward a top end of the wall panel. To hold the supports 50 on the wall panel 10, each sheathing support 50 is coupled to a respective load-bearing column 20 and runs parallel to the respective neighboring column 20. In the illustrated embodiment, each of the columns 20 includes a sheathing support 50 disposed on the visible first side 60 of each column. Together, the attachment surfaces 52 of the sheathing supports 50 form the first face 14 of the wall panel frame 12. It should be understood that the second sides 62 of the columns 20 would likewise include sheathing supports 50 with corresponding attachment surfaces 52 that form the second face 14 of the frame 12. Although a sheathing support is shown on each of the columns 20, it is conceivable that some columns 20 may not include a sheathing support disposed thereon. Further, while the sheathing supports 50 are shown as extending over the entire height of the wall panel 10, this construction is not necessary, and the sheathing supports 50 could be sized to extend over only a certain portion of the wall panel 10.

As can be seen in FIG. 2, there are no horizontal members extending across the wall panel 10 between the load distribution member 18 and the lower member 22. Of particular relevance is the fact that the wall panels disclosed herein may be constructed without structural bridging extending between the load-bearing columns. This ability is afforded by the large size and robust strength of the columns and, to a lesser extent, their centered position between the first and second faces of the wall panel.

In the particular embodiment shown in FIG. 2, the sheathing supports 50 are spaced apart from the load bearing columns 20 and attached thereto by spacers 54. As a result, a gap 56 is formed between sheathing supports 50 and the columns 20 to which they are attached. This gap 56 provides particular advantages as described in further detail below with respect to FIG. 3.

The configuration of the vertical sheathing supports 50 shown in FIG. 2 can be further explained with reference to FIG. 2A, which shows a top-view cross-section of a load-bearing column 20 of the wall panel 10 and sheathing supports 50 disposed on opposite sides 60, 62 of the column 20. As illustrated, the two sheathing supports 50 are configured in the form of channels including a web 70 and two flanges 72. The sheathing supports 50 are attached to the spacer 54 opposite the columns 20, and the spacers 54 are fixed on a respective side of the column 20. The channels of the sheathing supports 50 can be specifically arranged with the ends of the flanges 72 being fixed to the spacers 54 and the web 70 of the channels 50 providing the attachment surface 52 of the sheathing support 50. The spacers 54 define the distance between the sheathing supports 50 and the columns 20, and thus define the size of the gap 56 on each side of the wall panel 10. Various different structures can be used to form the spacers, including hollow tubing, thick material sheets, beams, or, as illustrated, a section of channel. The use of channel for the spacers 54 is particularly advantageous, since the material of the spacer 54 may be the same as that used for the sheathing support 50. In the illustrated construction, short sections of channel are disposed at 90° from the sheathing support channels and fixed to the respective side of the column. In particular, the spacer channel 54 is arranged with the channel opening against the column 20 and the flanges are attached to the respective column side 60, 62. The sheathing support channels 50 can then be fixed on the web 70 of spacer channel. Spacers 54 as shown in FIGS. 2 and 2A may be distributed at various locations along the respective load-bearing column 20 along the height of the wall panel 10.

Figure 2A:
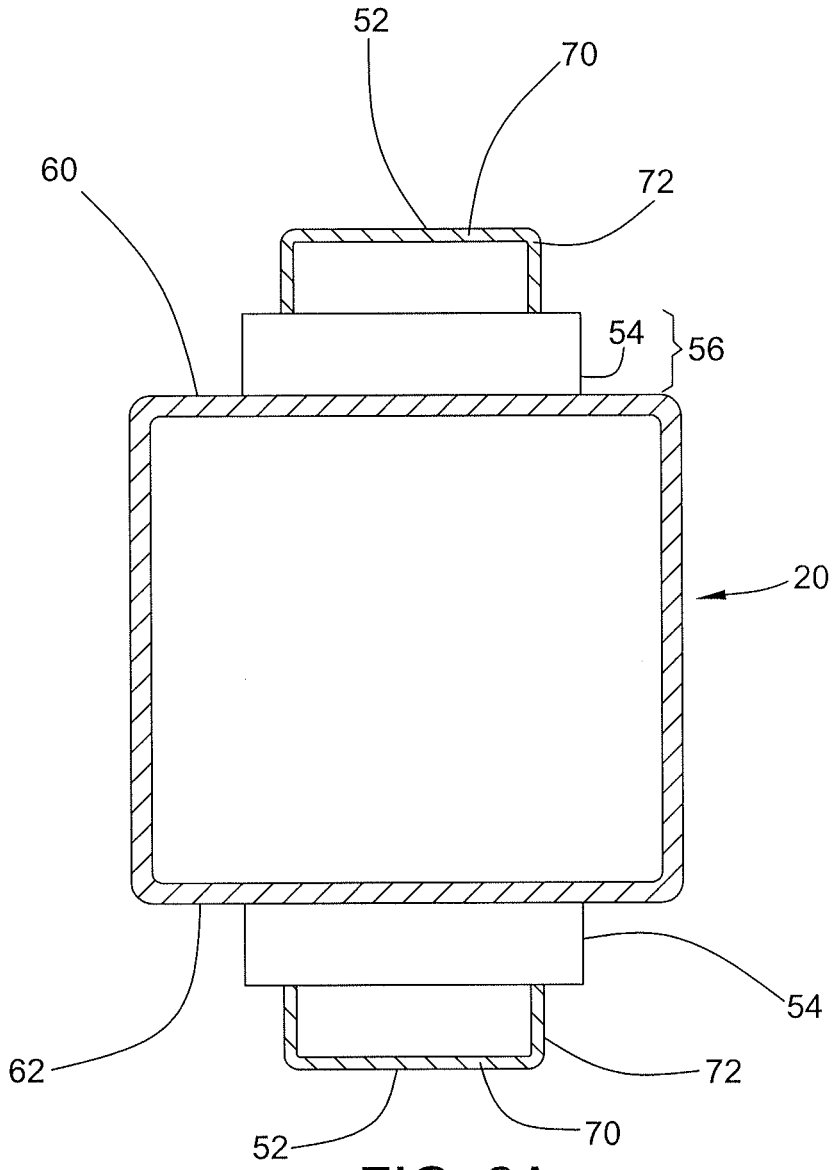
FIG. 2*a* shows a detailed top view of a column and sheathing support of the wall panel of FIG. 2.

The particular materials used in the illustrated construction of FIGS. 2 and 2A include 1.5×0.5 inch channel for both the sheathing supports 50 and the spacers 54. This construction forms an attachment surface 52 of the sheathing support 50 that is 1.5 inches wide, which provides adequate width for attaching various different types of sheathing material to the sheathing supports and is a standard desired width for accommodating a seam between two sheets of sheathing. Further, the use of the described channel for the supports 50 and spacers 54 provides a 0.5 inch gap between each sheathing support 50 and the respective side of the column 60, 62, and also positions the attachment surfaces 52 of the opposing sheathing supports 50 at 6 inches apart, such that the attachment surfaces align with the flanges 26 of the track of the lower member 22 and the flanges 36 of the structural channel 32 of the load distribution member 18.

Figure 3:
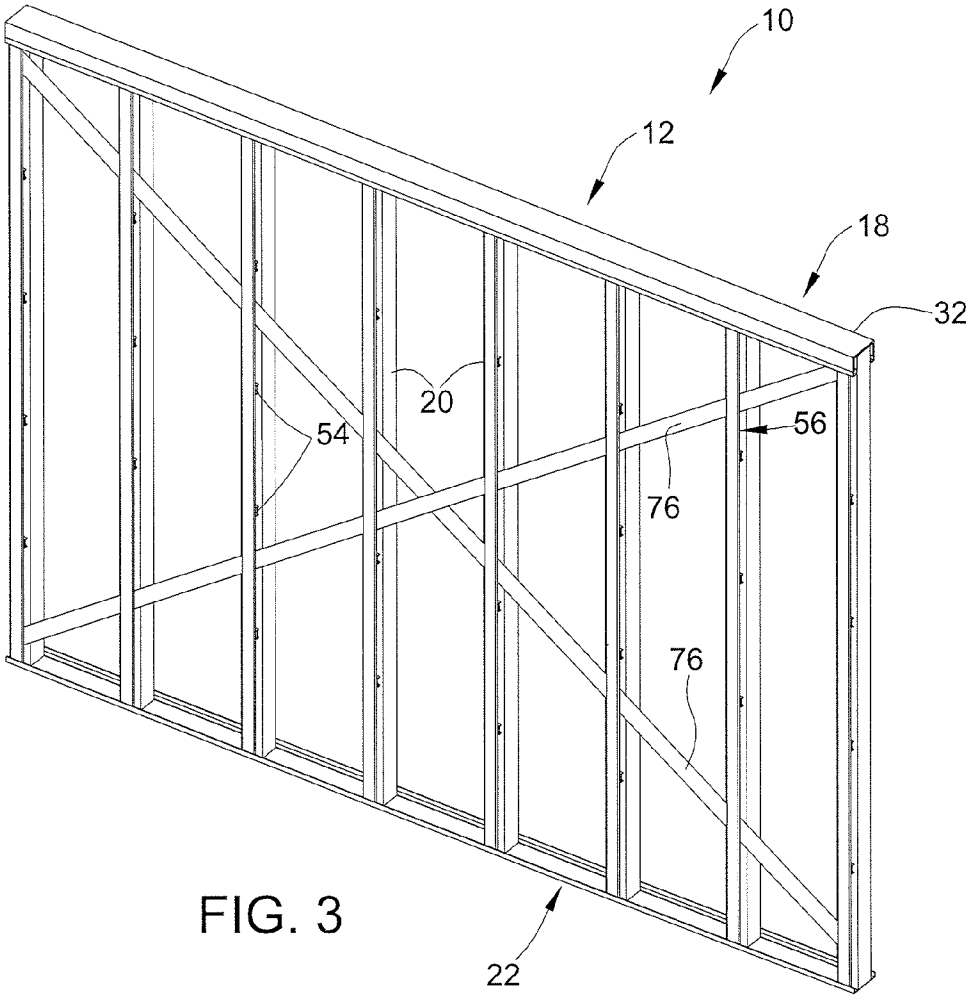
FIG. 3 shows a perspective view of another embodiment of a wall panel including centrally disposed load-bearing columns with cross braces.

FIG. 3 shows a wall panel 10 similar to that of FIG. 2, and including columns 20 that supported on a lower member 22 formed by a steel track channel, abutting a web 24 of the channel and centrally disposed between the flanges 26 of the channel. Likewise, the load distribution member 18 at the top of the wall panel 10 is also formed by a channel member 30 including a structural channel 32 opening downward and two guide elements 40 disposed at ends of the flanges 36 of the structural channel 32. Further, the sheathing supports 50 are again positioned vertically, and each is attached at a distance to a respective load-bearing column. It should be appreciated that each of the features of the wall panel shown in FIG. 3 may be embodied by the descriptions set forth above with respect to FIGS. 1 and 2, except where otherwise indicated.

Further, the wall panel 10 of FIG. 3 is specifically arranged to provide improved resistance to shear stresses, which makes this wall panel particularly suitable for use when constructing the core portion of a building, for surfaces of a building exposed to wind or seismic loading, or for any other wall portions expected to bear high shear loading. Specifically the wall panel 10 of FIG. 3 includes two cross braces 76, which extend in an "X" configuration between the four corners of the wall panel frame 12. The cross braces 76 are advantageously disposed in the gaps 56 between the columns 20 and sheathing supports 50. Thus, the location of the cross braces 76 is enabled by the spacers 54 disposed between the sheathing supports 50 and columns 20. In a preferred embodiment, each of the two cross braces is disposed on one side of the columns 20, so that each cross brace can utilize the full width of the gap. Alternatively, it is conceivable for the cross braces to be disposed on the same side of the columns 20. At their ends, the two cross braces 76 may be bolted, pinned, or welded to the load bearing columns 20 at the ends of the wall panel 10.

Figure 4:
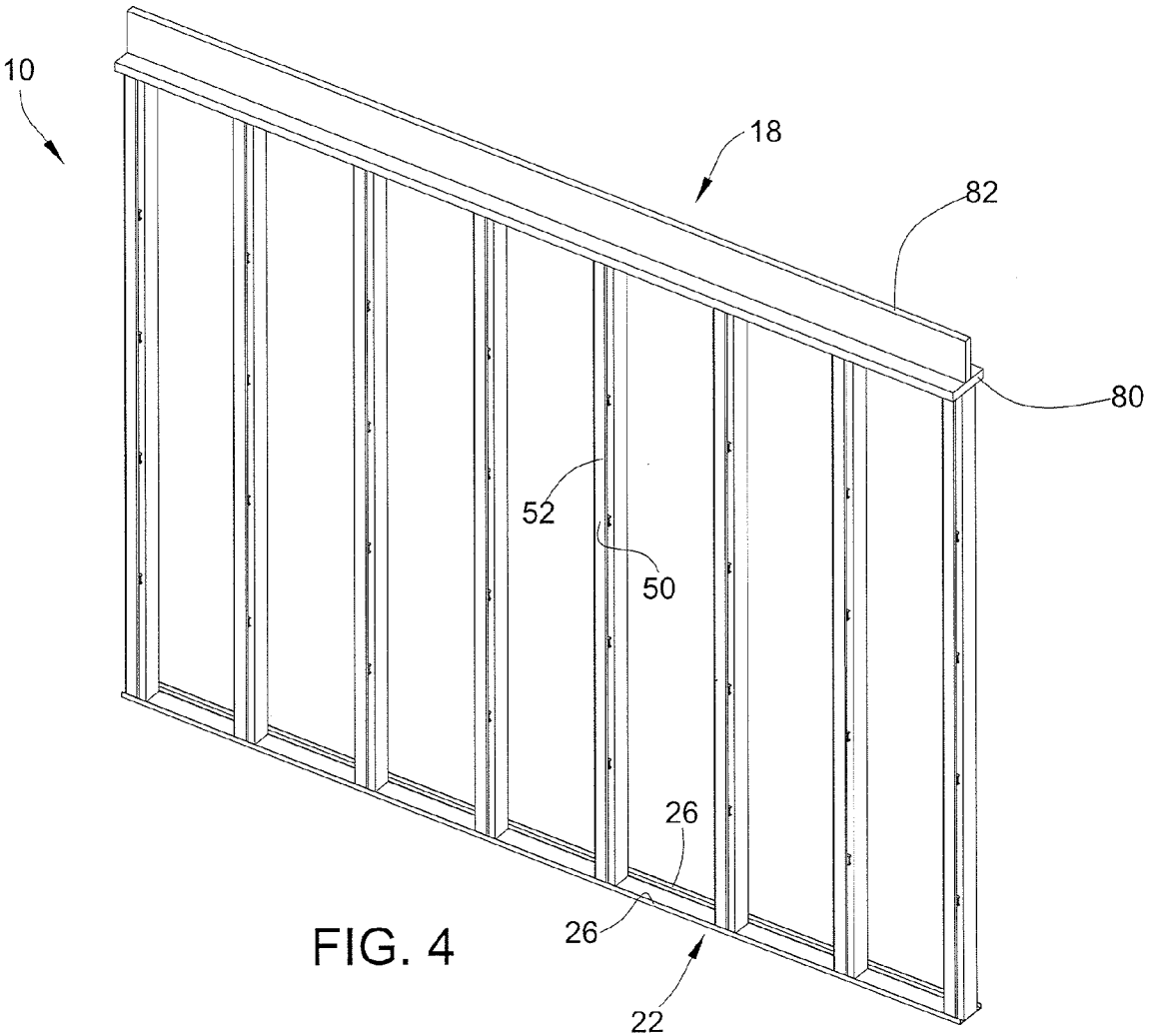
FIG. 4 shows a perspective view of another embodiment of a wall panel including centrally disposed load-bearing columns.

FIG. 4 shows a wall panel 10 also similar to that of FIG. 2, and including columns 20 that are supported on a lower member 22 formed by a steel track channel, abutting a web 24 of the channel and centrally disposed between the flanges 26 of the channel. Likewise, the sheathing supports 50 are again positioned vertically, and each is attached at a distance to a respective load-bearing column. It should be appreciated that each of the features of the wall panel shown in FIG. 4 may be embodied by the descriptions set forth above with respect to FIGS. 1 and 2, except where otherwise indicated.

The load distribution member 18 of the wall panel 10 of FIG. 4 differs from that of FIGS. 1-3. In FIG. 4, the load distribution member 18 is formed by a flat bar 80 extending across the top of the wall panel 10. The flat bar 80 is arranged horizontally with a wide side face laid over the top ends of the load-bearing columns 20. It may also be advantageous to include a vertical flat bar 82 extending up from the top of the horizontal bar 80. The vertical bar 82 provides additional support for bearing loads, particularly shear loads. Accordingly, the vertical bar 82 is particularly advantageous in a shear wall panel that includes cross braces 76, a shown in FIG. 3. It also possible to use the vertical bar 82 with the load distribution member 18 shown in FIGS. 1-3, which includes the channel member 30. The vertical flat bar 82 is preferably centrally aligned with the load-bearing columns 20, between the first and second faces 14, 16 of the wall panel frame 12. The two flat bars 80, 82 may be formed of the same size bar, or of different size metal flat bars. In the illustrated embodiment, the horizontal flat bar extends further outward than the attachment surfaces 52 of the sheathing supports 50 and the side flanges 26 of the lower member steel track 22. Thus, the sides of the horizontal flat bar may extend further outward than the frame faces 14, 16 that hold sheathing to the wall panel. This additional extension of the horizontal flat bar enlarges the support area of load distribution member 18, allowing additional space for supported structures, such as pre-cast concrete elements. In the particular embodiment shown in FIG. 4, both the horizontal and vertical flat bars are ⅜×9 inch bars.

Figure 5:
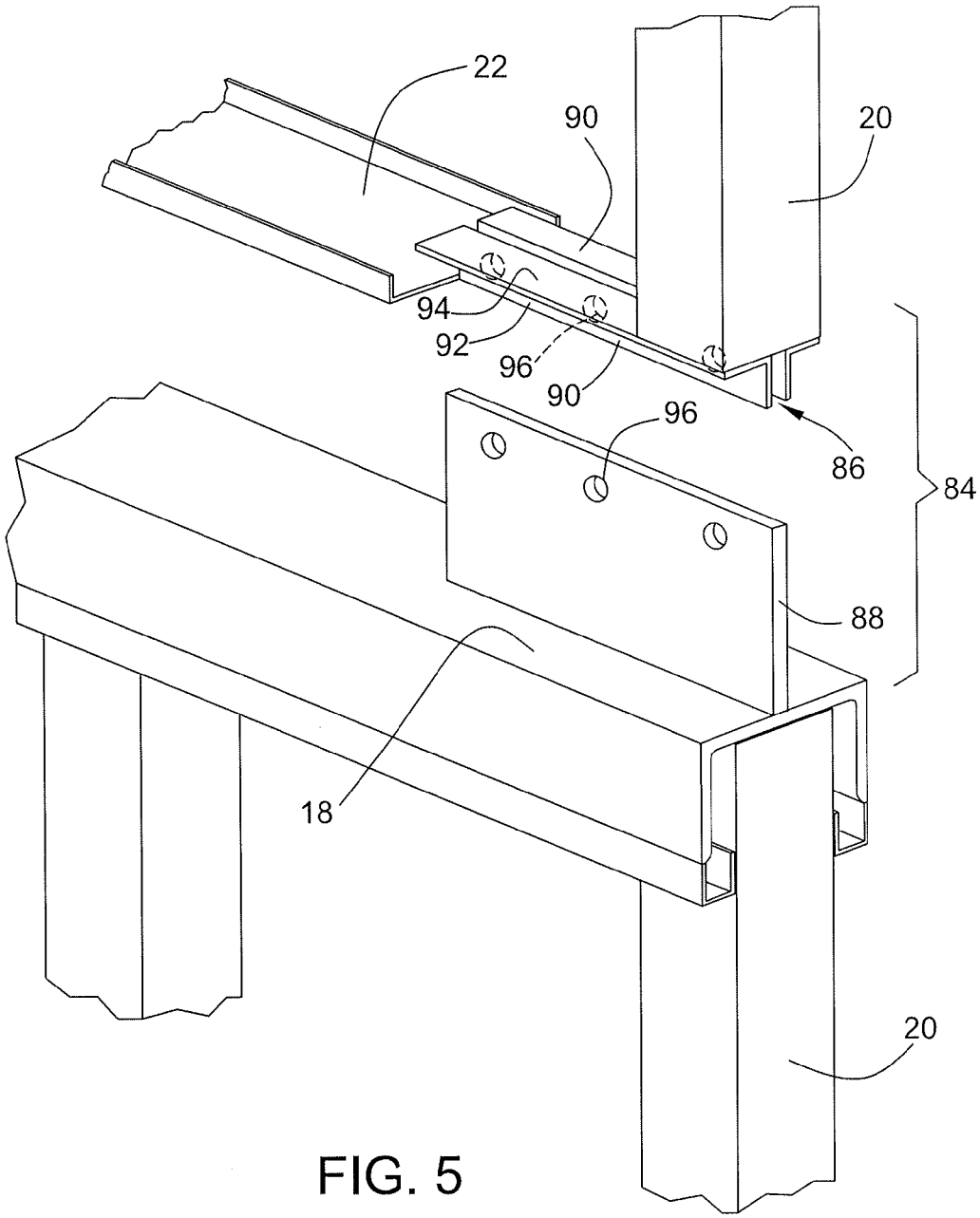
FIG. 5 shows a detailed exploded view of a wall panel connection.

FIG. 5 shows a connection 84 that may be included in any of the above wall panels 10 shown in FIGS. 1-4. The connection 84 is preferably included at both ends of the wall panel 10 and is formed by a vertical connecting bar 88 extending vertically upward from the load distribution member 18 of a lower wall panel 10 and is placed within a slot 86 disposed between two holding members 90 at the bottom of an upper wall panel 10. In the illustrated embodiment, each of the holding members 90 and the vertical connecting bar 88 includes connecting holes 96 distributed along their respective lengths. For connecting the lower wall panel and the upper wall panel the vertical connecting bar 88 is inserted into the slot 86 disposed between the two holding members 90. Preferably, the width of the slot 86 is substantially equal to the width of the connecting bar 88 so that a snug fit is formed between these two elements. With the connecting bar 88 and holding members 90 assembled, the connecting holes 96 of the vertical connecting bar 88 and the holding members 90 are preferably aligned so that bolts can be passed through the holes 96 and secured to firmly hold the upper and lower wall panels together but at a spaced-apart relation that leaves a horizontally extending gap that can accommodate the structure of a floor that is poured or otherwise built therebetween. The connection 84 is particularly advantageous because a strong connection can be made between the upper and lower wall panels without the need for welding the panels together. As a result, any welding that is required for the construction of the individual wall panels 10 can be accomplished off-site at a manufacturing location, but at the construction site of a building the panels can be easily and quickly attached using bolts. This connection 84 is particularly advantageous for connecting shear wall panels, such as that which is shown in FIG. 3, so that shear loading can be appropriately transferred through the connected wall panels 10.

In the embodiment shown in FIG. 5, the vertical connecting bar 88 is formed by a section of steel flat bar extending up from the load distribution member 18. In a particular embodiment, the connecting bar 88 is formed by a flat bar having a thickness of about ⅜ of an inch and a length of about 9 inches. The holding members 90 are formed by two steel angles, each having a vertically extending leg 92. The two vertically extending legs are spaced apart to form the slot 86 in which the vertical connecting bar is inserted. In the particular embodiment shown, the vertical legs 92 of the holding members 90 are spaced slightly more than ⅜ of an inch apart to accommodate the vertical connecting bar 88 with a clearance fit. The angle holding members 90 are each arranged to have a horizontal leg 94 above the vertical leg 92 and extending outward from the slot. In combination the horizontal legs 94 of the two holding members 90 form a platform to support a column 20 at the end of the wall panel 10, and thus the holding members 90 form a part of the lower member 22 that supports the columns 20.

In the illustrated embodiment, the holding members 90 are formed as a section of the lower member 22 in place of a section of the steel track. Due to the additional height of the holding members 90 compared to the thickness of the web 24 of the track, the column 20 at the end of the wall panel 10 where the connection 84 is used may be slightly shorter than the other columns, since the bottom of the column 20 at the end of the wall panel will be raised in comparison to the bottom of the remaining end columns of the wall panel. In FIG. 6, the track is illustrated as stopping where the holding members 90 begin. Alternatively, the track can extend to the end of the wall panel, so long as a slot is cut into the track in order to avoid blocking the connecting bar 88 from being inserted into slot 86. As an additional alternative, the holding members 90 could be disposed entirely beneath the track, so that the lower member 22 includes both the steel track and the two holding members 90 attached to a bottom of the track. This configuration allows the connection 84 to be provided by merely including the holding members 90 as a part of the lower member 22 below the steel track, and no other modification to the lower end of the wall panel is necessary.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A wall panel configured as a load-bearing structure for supporting vertical loading in a building, the wall panel forming a frame with first and second faces configured to receive sheathing and having a frame thickness defined between the first and second faces, the wall panel comprising:

a plurality of axial load-bearing vertical columns for collectively supporting the vertical loading in the building, each of the plurality of vertical columns being centrally disposed between the first and second faces of the wall panel frame;

a load distribution member disposed at a top of the wall panel and coupled to the plurality of load-bearing columns, the load distribution member providing a support platform for loads disposed on top of the wall panel that are part of the vertical loading of the building, the load distribution member operating to direct the loads down and through each of the plurality of axial load-bearing vertical columns, and the load distribution member being wider than each of the plurality of axial-load-bearing vertical columns such that a gap is formed on either side of the wall panel;

a lower member disposed at a bottom of the wall panel and supporting the plurality of load bearing columns, the lower member being wider than each of the plurality of axial load-bearing vertical columns such that the gap extends across a height of the wall panel;

a plurality of first sheathing supports disposed on a first side of the plurality of the load-bearing vertical columns within the gap, each of the first sheathing supports including an attachment surface disposed at a distance from the load-bearing vertical columns, the attachment surfaces of the respective first sheathing supports, along with the load-distribution member and the lower member, defining the first face of the wall panel frame and being configured to hold a sheathing on the wall panel frame; and a plurality of second sheathing supports disposed on a second side of the plurality of the load-bearing vertical columns within the gap, each of the second sheathing supports including an attachment surface disposed at a distance from the load-bearing vertical columns, the attachment surfaces of the respective second sheathing supports, along with the load-distribution member and the lower member, defining the second face of the wall panel frame and being configured to hold a sheathing on the wall panel frame.

2. The wall panel of claim 1, wherein the first and second sheathing supports extend horizontally along a length of the wall panel.

3. The wall panel of claim 1, wherein each of the plurality of first sheathing supports extends vertically and parallel to a respective neighboring column of the plurality of load-bearing vertical columns.

4. The wall panel of claim 3, wherein each of the plurality of first sheathing supports is disposed at a distance from the respective neighboring column so as to form the gap between the plurality of first sheathing supports and plurality of load-bearing columns, the gap extending along a length of the wall panel.

5. The wall panel of claim 4, wherein each of the plurality of first sheathing supports is coupled to the respective neighboring column by at least one solid spacer.

6. The wall panel of claim 5, wherein each of the plurality of first sheathing supports is coupled to the respective neighboring column by a plurality of spacers disposed apart from one another along a height of the respective column.

7. The wall panel of claim 4, further comprising at least one cross brace extending diagonally across the height and length of the wall panel, the at least one cross brace being disposed within the gap between the plurality of first sheathing supports and plurality of load bearing vertical columns.

8. The wall panel of claim 3, wherein the wall panel is free of horizontal bridging extending between the load-bearing vertical columns.

9. The wall panel of claim 1, wherein the load-bearing columns are steel tubes having a generally rectangular cross section.

10. The wall panel of claim 1, wherein the load distribution member includes a structural channel with a web disposed on a top end of the load-bearing vertical columns and two flanges extending downward from the web on opposite sides of the load-bearing vertical columns.

11. The wall panel of claim 10, wherein the load distribution member further includes a guide element attached at a lower end of each downwardly extending flange of the structural channel, the guide elements providing a guide support on opposite sides of the load bearing vertical columns.

12. The wall panel of claim 1, wherein the load distribution member includes a horizontal flat bar with a lower side face disposed on a top end of the load-bearing vertical columns.

13. The wall panel of claim 1, further comprising a vertical flat bar extending up from the load distribution member, the vertical flat bar being centrally positioned with respect to the first and second faces of the wall panel frame.

14. The wall panel of claim 1, further comprising a vertical holding bar extending up from the load distribution member and disposed at an end of the wall panel, the vertical holding bar being configured to form a connection with at least one holding member disposed at a bottom of an adjacent wall panel.

15. The wall panel of claim 14, wherein the vertical holding bar includes holes for receiving bolts to form the connection with the at least one holding member of the adjacent wall panel.

16. The wall panel of claim 1, wherein the lower member includes two holding members disposed at an end of the wall panel and being configured to form a connection with a holding bar disposed at a top of an adjacent wall panel.

17. The wall panel of claim 16, wherein each of the two holding members includes holes for receiving bolts to form the connection with the holding bar of the adjacent wall panel.

* * * * *